US006756896B2

(12) United States Patent
Ford

(10) Patent No.: US 6,756,896 B2
(45) Date of Patent: Jun. 29, 2004

(54) DISTRIBUTED RESIDENTAL ALARM SYSTEM AND METHOD THEREFOR

(76) Inventor: Michael Brent Ford, 2716 Rio Vista, St. George, UT (US) 84790

( * ) Notice: Subject to any disclaimer, the term of this patent is extended or adjusted under 35 U.S.C. 154(b) by 0 days.

(21) Appl. No.: 10/122,878

(22) Filed: Apr. 11, 2002

(65) Prior Publication Data

US 2003/0193393 A1 Oct. 16, 2003

(51) Int. Cl.[7] ..... G08B 29/00

(52) U.S. Cl. ..... 340/506; 340/507; 340/508; 340/539.1; 340/539.14; 340/3.1

(58) Field of Search ..... 340/506, 507, 340/508, 509, 522, 523, 531, 539; 390/517–521, 524, 525, 539.1, 539.14, 3.1, 507

(56) References Cited

U.S. PATENT DOCUMENTS 3,792,455 A * 2/1974 Phillips ..... 340/224
3,909,826 A * 9/1975 Schildmeier et al. ..... 340/524
4,363,031 A * 12/1982 Reinowitz ..... 340/539.26
4,417,235 A * 11/1983 Del Grande ..... 340/531
4,550,311 A * 10/1985 Galloway et al. ..... 340/531
4,673,920 A * 6/1987 Ferguson et al. ..... 340/521
4,792,946 A * 12/1988 Mayo ..... 370/245
5,463,595 A * 10/1995 Rodhall et al. ..... 367/93
5,898,369 A * 4/1999 Godwin ..... 340/539.26
5,999,089 A * 12/1999 Carlson ..... 340/328
6,078,269 A * 6/2000 Markwell et al. ..... 340/825.5
6,369,705 B1 * 4/2002 Kennedy ..... 340/506
6,420,973 B2 * 7/2002 Acevedo ..... 340/628

* cited by examiner

*Primary Examiner*—Daryl Pope
(74) *Attorney, Agent, or Firm*—A. Mitchell Harris; Jeffrey D. Moy; Weiss, Moy & Harris, P.C.

(57) ABSTRACT

A distributed residential alarm system and method provides protection of occupants and property from loss due to theft or hazardous conditions in the residence such as fire or flooding. The alarm system includes multiple alert detectors coupled via a wireless connection to multiple control units each capable of providing master control functions. The control units and detectors communicate with the detectors and each other via a token-passing scheme, whereby unit pairs may be located within the distance limitations of each nodal connection, thus providing coverage over a longer distance than would be possible with communication to a central unit. The system also provides modularity and scalability in that sensors may be easily added to the system and the system is not dependent on any one of the control units in order to function. An apartment management system provides an alternative organization wherein apartment dwellers all can be notified of an alert condition in one of the premises, while preventing false alarm nuisance by initially limiting the alarm to the unit where the alarm condition exists. If after a predetermined time, the alarm in the originating unit has not been cancelled, the other units are notified.

25 Claims, 4 Drawing Sheets

DISTRIBUTED RESIDENTAL ALARM SYSTEM AND METHOD THEREFOR

CROSS REFERENCE TO RELATED APPLICATIONS

The present application is related to U.S. patent application Ser. No. 10/122,880 entitled "METHOD AND SYSTEM FOR CONTROLLING A HOUSEHOLD WATER SUPPLY" filed concurrently with this application.

BACKGROUND OF THE INVENTION

1. Field of the Invention

The present invention relates generally to household systems, and more specifically, to a residential alarm system having a distributed control function.

2. Background of the Invention

Residential alarm systems provide security for occupants and protection of property from theft and extensive damage due to fire or flooding. A typical alarm system includes a main control unit and multiple sensors wired to the control unit for detecting smoke, heat, water, and unauthorized entry conditions such as door and window opening, glass breakage and motion inside a building. The alarm system typically connects to a telephone line and one or more audible alarms (speakers, buzzers, sirens, etc.). The telephone connection is generally susceptible to tampering, but may be improved by periodic "call-in" polls by a security monitoring service, or by burying the telephone lines to limit accessibility.

Recently, wireless connections have been used to the main unit, to reduce the cost of installing wiring within a residence equipped with an alarm system and reduce the potential for disabling a sensor by tampering with the wiring. While the wireless connections provide improved operation and reduced installation cost, existing alarm systems are still dependent on a centralized control system that may fail or be bypassed through tampering. The central control unit also is limited in the number of loop connections for receiving sensor input, and therefore is generally not scalable, i.e., larger units must be purchased when upgrading past a predetermined capacity for a particular alarm system model.

Therefore, it would be desirable to provide a residential alarm system and method that is modular, scalable and is resistant to being disabled. It would further be desirable to provide a residential alarm system and method for notifying apartment dwellers of alarm conditions without disrupting an entire building with false alarms. It would further be desirable to provide a residential alarm system and method that are resistant to tampering with external connection such as telephone lines.

SUMMARY OF THE INVENTION

The above objective of providing a residential alarm system that is modular, scalable and is resistant to being disabled and that may be adapted to notify apartment dwellers of alarm conditions without disrupting an entire building, is achieved in a residential alarm system and method that include a distributed control function. The system comprises multiple alert condition detectors and multiple control units. Each of the control units capable of providing a master control function whereby the alarm system may be enabled or disabled and inputs from detectors converted to an audible or other alarm response.

The detectors and control units are connected via a wireless interface, and the system may communicate via a token passing mechanism that provides a fault-tolerant connection whereby the units may be located at greater distances than would be required for communication that is directed at one centralized location.

The foregoing and other objectives, features, and advantages of the invention will be apparent from the following, more particular, description of the preferred embodiment of the invention, as illustrated in the accompanying drawings.

DETAILED DESCRIPTION OF THE PREFERRED EMBODIMENTS

Figure 1:
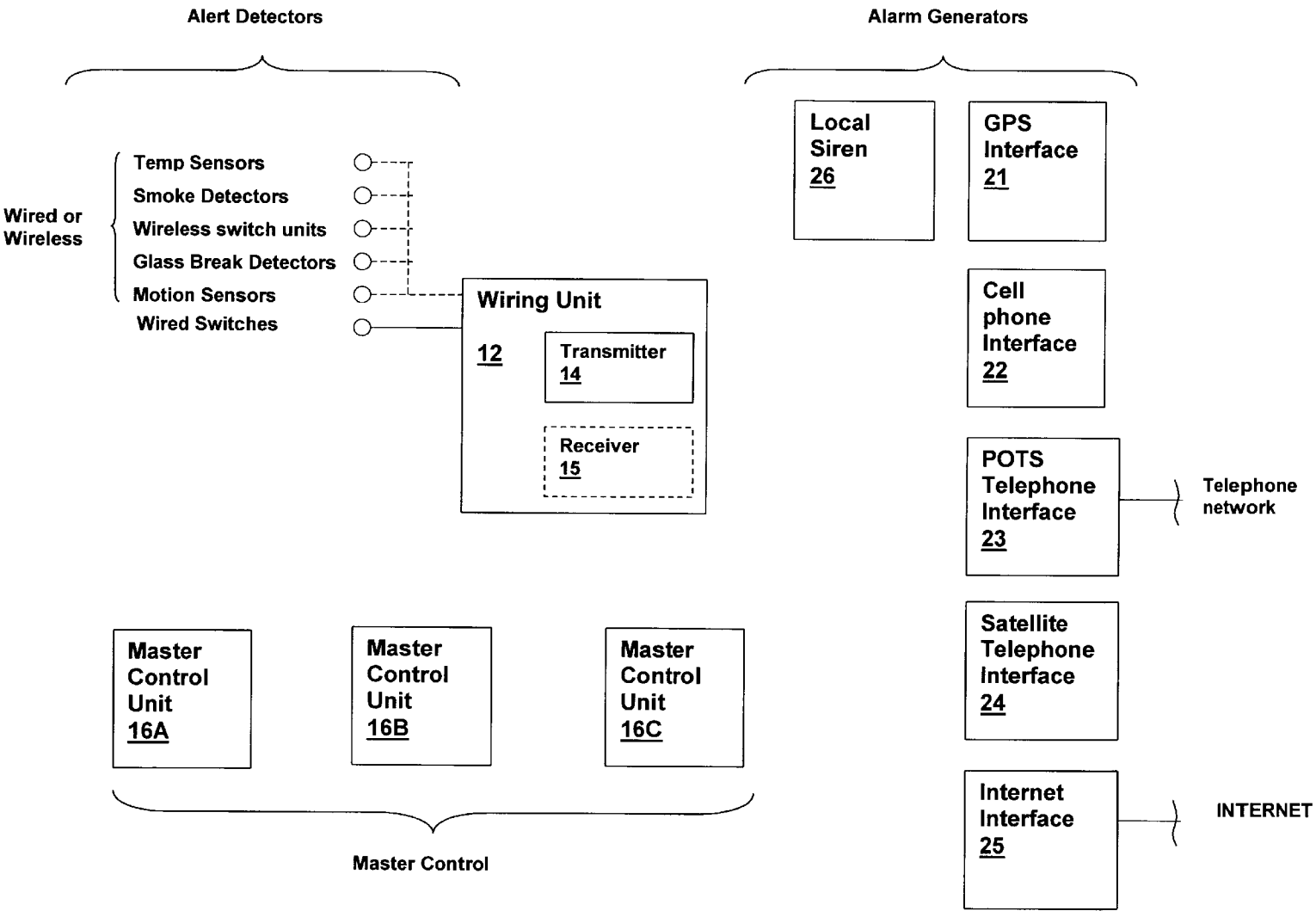
FIG. 1 is a schematic diagram depicting a system in accordance with an embodiment of the present invention.

Referring now to the figures and in particular to FIG. 1, a residential alarm system in accordance with an embodiment of the present invention is shown. The system generally includes multiple alert detectors for determining various emergency conditions that may exist within a residence, alarm generators for generating various alarms in response to alert conditions, and multiple wireless master control units 16A–16C that can independently control the system.

While wireless alert detectors have existed for some time, in the prior art, they are typically coupled to a single master control unit that controls the operation of the alarm system, generating alarms in response to a wireless alert signal. The present invention embodies an alarm system having distributed control using multiple master control units for redundancy, ease of installation and to achieve a greater operating range through a token-passing scheme that permits the master control units to pass alert signals (detected condition), alarm signals (notifying signal) and control signals between master control units, forming a "bucket brigade" that can deliver information from one end of the system to another, as long as each adjacent pair of master control units are located within the transmission/reception range distance.

The alert detectors include: temperature sensors for generating alerts in response to temperatures that are too low (potential water system freezing warning), too high (pet environment warnings or potential fire warnings); smoke detectors; door and window switches; glass breakage detectors; motion sensors and other alert detectors that are generally used within residential alarm systems. A wiring unit 12 provides an optional interface for sensors that are not supplied in a wireless form, or to provide an interface for low-cost door and window switches that do not include a transmitter for generating a wireless alert signal.

Wiring unit 12 contains at least a transmitter 14 for generating a wireless alert signal and optionally a receiver 15 for receiving control information. The transmitters and receivers used in embodiments of the invention may be radio-frequency transmitters and receivers, infrared transceivers, or other suitable wireless communication links. In addition, the links from the alert detectors may be infrared while the links among the master control units and the alarm generators may be radio-frequency, or vice-versa.

The alarm generators provide notification of a resident or a remotely located person or service of a potentially dangerous or emergency condition within the residence. Local siren 26 provides an audible alarm to alert persons in the residence, A global positioning satellite (GPS) interface 21 provides GPS emergency notification through an uplink (and location information through a downlink that may be transmitted back to master control units 16A–16C and through another channel to provide location information regarding the residence). A cellular telephone interface 22 provides a telephone communication channel that cannot be disrupted by cutting wires, as does a satellite telephone interface 24. An Internet interface 25 and plain old telephone system (POTS) interface 23 provide land-line connections for the alarm system to remotely located residents or services.

All of the above listed alarm generators are optional and may be used in any combination to provide a customized design appropriate to a particular application. Further, the non-wired alarm generators such as cellular telephone interface 22, satellite telephone interface 24 and GPS interface 21 may be incorporated within one or more of master control units 16A–16C to provide an alarm generation capability within the master control units that cannot be disabled by cutting wires, and may be redundant in that alarm generators may be located within each of master control units 16A–16C. Local siren 26 can and generally will be located within each of master control units 16A–16C, providing an audible alert via a piezoelectric buzzer than can produce 87 dB of acoustic signal.

Figure 2:
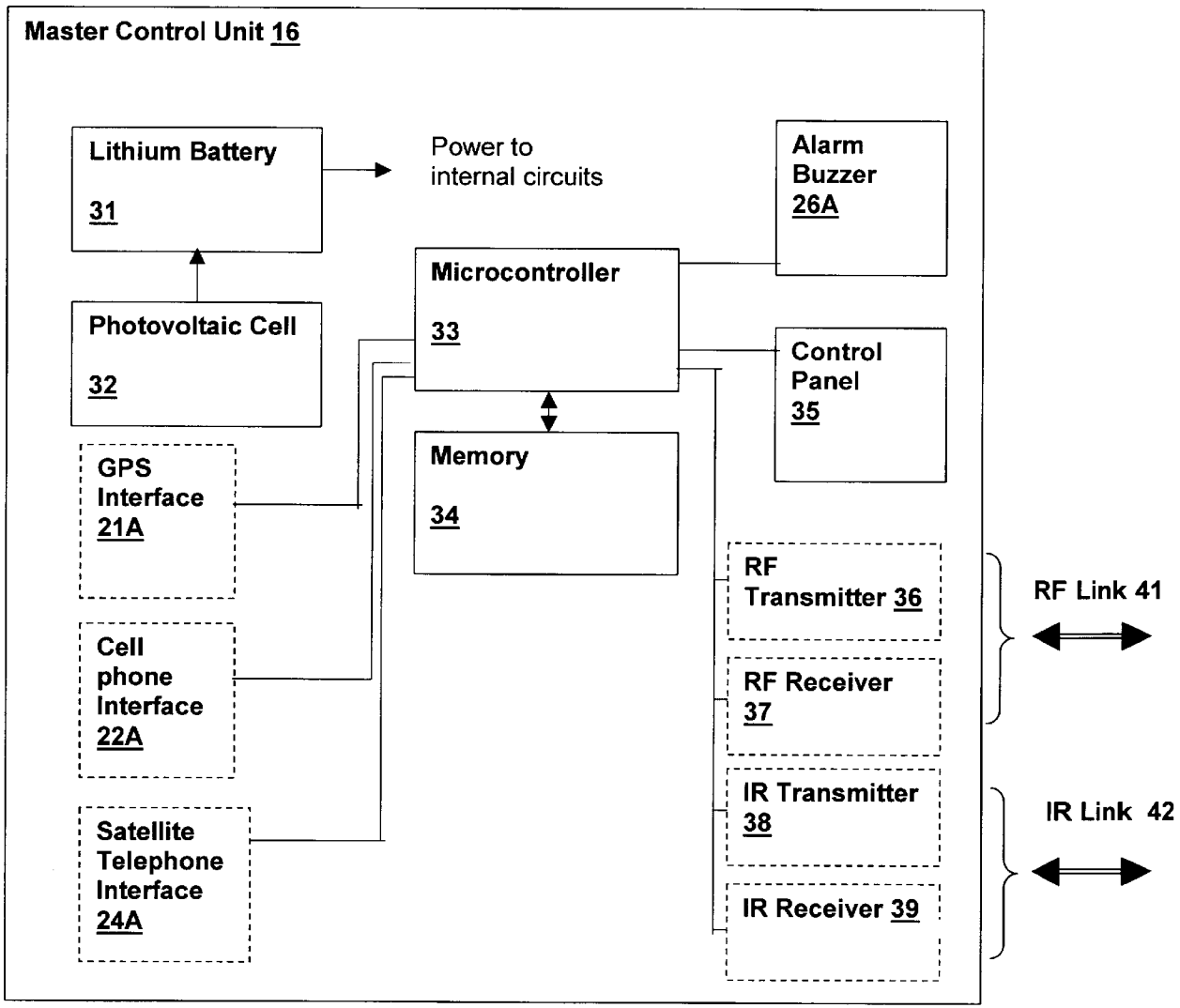
FIG. 2 is a block diagram depicting a master control unit in accordance with an embodiment of the present invention.

Referring now to FIG. 2, a master control unit 16 in accordance with an embodiment of the invention is depicted. A lithium battery 31 supplies power to the internal circuits, and master control unit 16 is isolated from any wiring associated with the alarm system. A photovoltaic cell 32 is included with appropriate charging circuitry to replenish lithium battery 31 so that periodic recharging is not required. As long as master control unit 16 can be located in a lighted area or outdoors in the path of incident sunlight, master control unit requires no external power source to operate indefinitely. Further, as master control unit 16 is not wired to the residence in any way, it may be relocated to a lighted area for periodic recharging if required.

A microcontroller 33 is coupled to a memory 34 for providing the control functions within master control unit 16. Memory 34 may be completely contained within an integrated circuit comprising microcontroller 33 core or may be an external memory 34. Memory 34 contains program instructions for operating master control unit 16 and storage area for temporary and permanent data values. Flash memory or other non-volatile storage such as EEPROM or EPROM may be used for the program instruction storage, or the program values may be stored in RAM that is maintained by lithium battery 31. The program within memory 34 receives external wireless signals via RF receiver 37 or IR receiver 39 and determines whether an alert condition has been received. Microcontroller 33 then echoes the receive alert condition to other master control units via RF transmitter 36 (or IR transmitter 38) to provide notification to the other master control units in the chain. Microcontroller also activates alarm buzzer 26A and may send notification through one or more of GPS interface 21A cellular phone interface 22A or satellite telephone interface 24A, after a suitable time delay has elapsed that provides a resident the opportunity to cancel the alarm condition. A second time delay is provided prior to activating alarm buzzer 26A for door switches, etc., to provide a resident time to cancel an alert condition caused by entry into the residence.

A control panel 35 is provided to enable a resident a means to program, control and alert the system via master control unit 16 and the commands entered may be echoed to other master control units to notify them that the system is being armed, reprogrammed, disarmed, alerted, etc.

Figure 3:
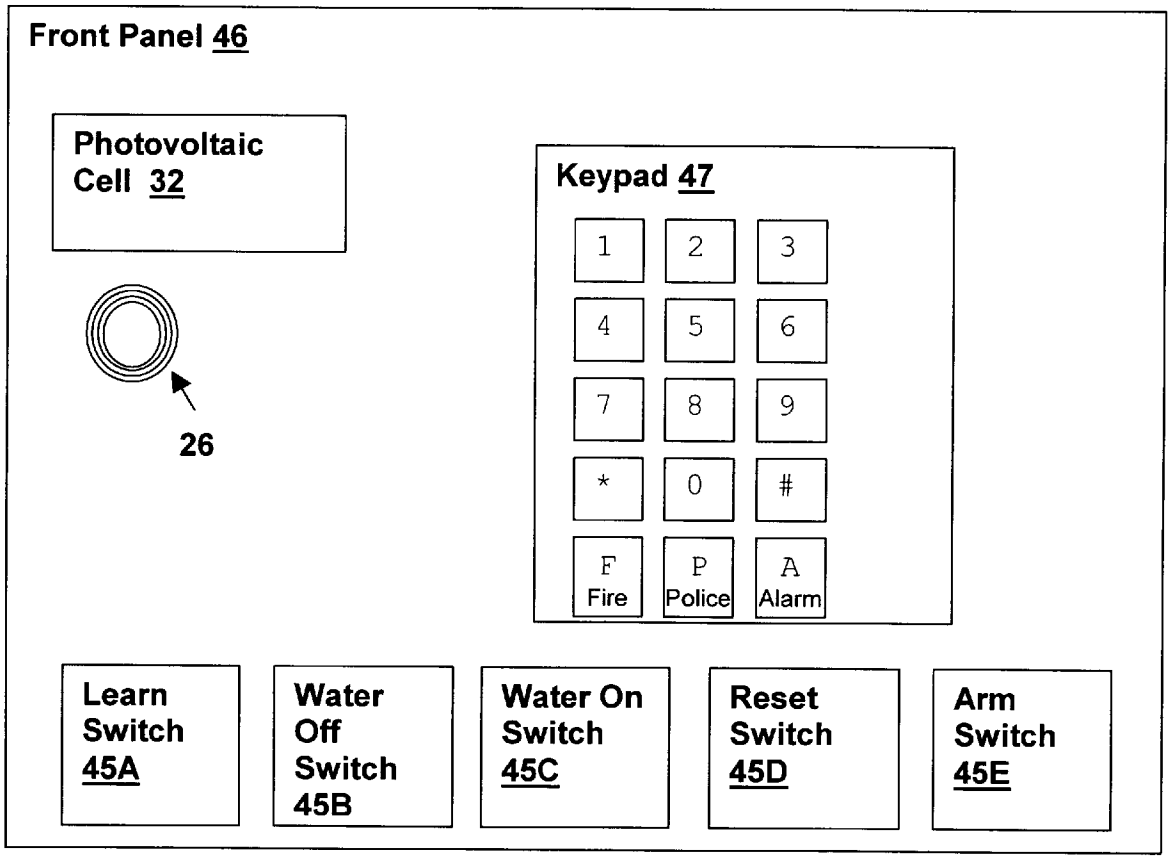
FIG. 3 is a pictorial diagram depicting a front panel of a master control unit in accordance with an embodiment of the invention.

Referring now to FIG. 3, a pictorial diagram of a front panel 46 of master control unit 16 is shown. A keypad 47 provides for programming and alarm code entry, as is found within standard alarm systems. Fire, Police and Alarm buttons are provided to permit immediate entry of alarm conditions from front panel 46. Alarm buzzer 26 is located on front panel 46 to produce an audible alarm, photovoltaic cell 32 is located on front panel 46 to permit light to strike the surface of photovoltaic cell 32. A learn switch 45A, water off switch 45B and water on switch 45C are provided for control of a household water control system as described in U.S. patent application "METHOD AND SYSTEM FOR CONTROLLING A HOUSEHOLD WATER SUPPLY" Ser. No. 10/122,880 filed concurrently herewith and which is herein incorporated by reference. The distributed concepts of the present invention may be used with the household water supply control system described in the above-referenced patent application, so that message passing from and to the motion sensors, water control valve and control units are integrated within the token-passing chain for control and alarm.

Finally, a reset switch 45D and an arm switch 45E are provided to arm and disarm the system. The water control system described in the above-incorporated patent application shows a hard-wired water control and alarm system, but the techniques of the present invention are applied to the water control system by incorporating RF transceivers (or IR transceivers) either within the water control unit as described in the above-incorporated patent application, or by adding wireless capability to the water control valve drive circuitry and using wireless motion detectors as described above for the alert detectors of the system of the present invention. The program code for executing the methods of the above-incorporated patent application can then be embedded within memory 34, providing water control functions within master control unit 16 of the present invention.

Figure 4:
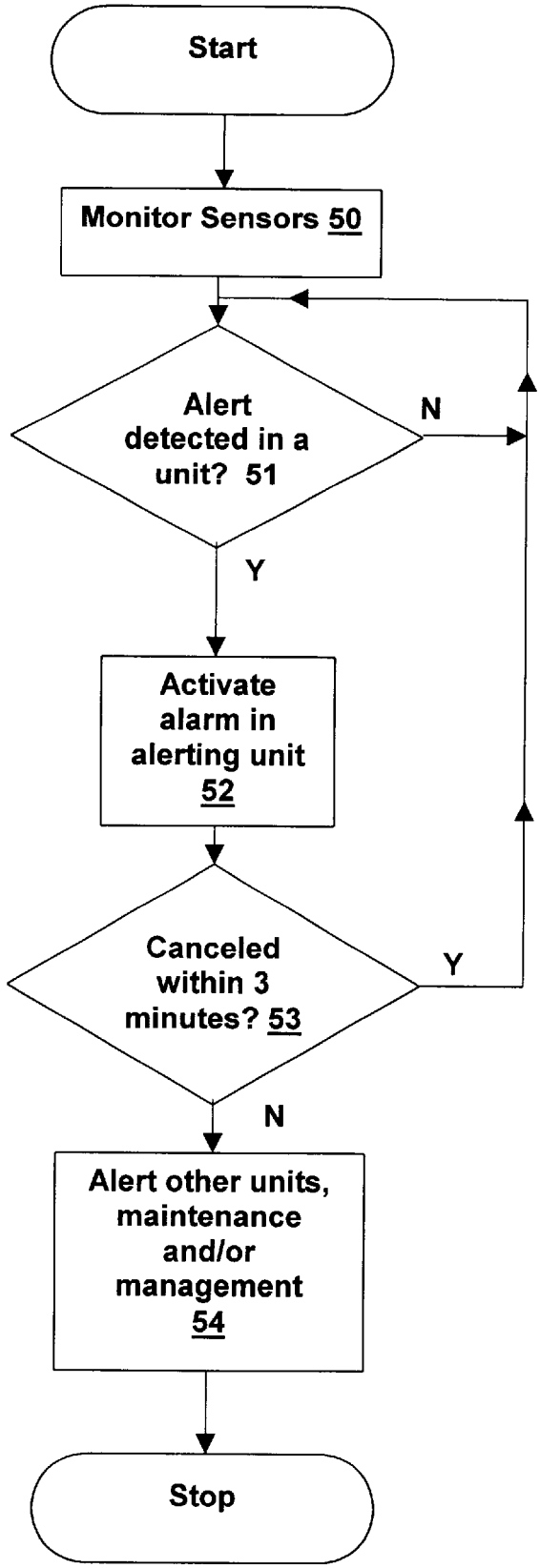
FIG. 4 is a flowchart depicting a method in accordance with an alternative embodiment of the invention.

Referring now to FIG. 4, a method in accordance with an alternative embodiment of the invention is depicted in a flowchart. While the above-described operation is an operation for a residence, within an multi-family dwelling, it is desirable to provide notification of all residence of a building or complex, without generating undesirable false alarms. In accordance with this goal, an alternative embodiment of the invention as applicable to multi-family dwellings is provided. Within one dwelling unit, a local master control unit 16 monitors the local alert detectors (sensors) (step 50). When a local alert is received or detected (decision 51), an alarm is activated within the dwelling unit (step 52). A three-minute (or other) delay is initiated, providing an occupant of the dwelling unit time to reset the alarm, but if the alarm is not canceled within the three minutes (decision 53), other dwelling units and/or a maintenance facility (manager's office/apartment) is notified (step 54).

While the above-mentioned delay is provided for automatic sensors for false alarms, the delay does not affect the alarm generated from pressing one of the "immediate" alarm buttons such as Fire, Police or Alarm buttons of keypad 47. The alarm button in the apartment model may be connected to provide immediate notification of the apartment manager or other service provider such as a security agency.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. An alarm system for alerting an occupant of emergency conditions within a residence, said system comprising:

a plurality of alert detectors for detecting said emergency conditions and generating a wireless alert signals;

a plurality of master control units coupled via a wireless connection to said alert detectors and to each other, each of said master control units configured to receive alerts from any of said alert detectors within a wireless reception range, whereby each of said master control units receives wireless control signals and said wireless alert signals from any of said alert detectors that are within said wireless reception range, wherein each of said master control units communicates wireless control signals for reception by other master control units within said wireless reception range, and wherein each of said master control units can control said system independently of the remaining master control units; and at least one alarm generator coupled to said plurality of master control units for generating an alarm in response to at least one of said plurality of master control units receiving an alert from at least one of said plurality of alert detectors.

2. The system of claim 1, wherein said master control units provide a distributed control function wherein said wireless alert signal is received by a first one of said master control units and communicated to a second one of said master control units.

3. The system of claim 1, wherein said master control units provide a distributed control function wherein a control input activated at a first one of said master control units is communicated to a second one of said master control units.

4. The system of claim 1, wherein said wireless connection between said plurality of master control units is a token passing connection, whereby operational distance between said plurality of master control units is maximized by passing control and alert signals from a first one of said master control units to a second one of said master control units.

5. The system of claim 1, wherein each of said master control units includes a radio-frequency transmitter and a radio-frequency receiver, and wherein said wireless connection is a radio frequency connection.

6. The system of claim 1, wherein each of said master control units includes an infrared transmitter and an infrared receiver, and wherein said wireless connection is an infrared connection.

7. The system of claim 1, wherein each of said plurality of master control units includes a battery, whereby all of the power required for operating said master control unit is provided within said master control unit.

8. The system of claim 7, wherein each of said plurality of master control units includes a photo-voltaic cell coupled to said battery, whereby said battery may be recharged by conversion of energy from light incident on said master control unit.

9. The system of claim 1, wherein said at least one alarm generator is coupled to said plurality of master control units via a wireless connection.

10. The system of claim 9, wherein said at least one alarm generator comprises a global positioning system emergency signaling generator.

11. The system of claim 9, wherein said at least one alarm generator comprises a standard telephone connection.

12. The system of claim 9, wherein said at least one alarm generator comprises a cellular telephone transceiver.

13. The system of claim 9, wherein said at least one alarm generator comprises a satellite telephone transceiver.

14. The system of claim 9, wherein said at least one alarm generator comprises an INTERNET connection.

15. The system of claim 1, wherein said at least one alarm generator is contained within at least a given one of said plurality of master control units.

16. The system of claim 15, wherein said at least one alarm generator includes a high output alarm buzzer within said given master control unit.

17. The system of claim 15, wherein said at least one alarm generator comprises a global positioning system emergency signaling generator located within said given master control unit.

18. The system of claim 15, wherein said at least one alarm generator comprises a cellular telephone transceiver located within said given master control unit.

19. The system of claim 15, wherein said at least one alarm generator comprises a satellite telephone transceiver located within said given master control unit.

20. The system of claim 1, wherein said at least one alarm generator comprises a local alarm generator associated with a given one of said plurality of master control units and at least one additional remote alarm generator, and wherein said local alarm generator is activated in response to said wireless alert signal without activating said remote alarm generator, and wherein if said local alarm generator is not deactivated within a predetermined time period, said remote alarm generator is activated in response to expiration of said predetermined time period.

21. An alarm system for alerting an occupant of emergency conditions within a residence, said system comprising:

a plurality of alert detectors for detecting said emergency conditions and generating a plurality of wireless alert signals;

wireless control means for controlling said alarm system from a plurality of locations, wherein said control means provides independent master control of said system, said wireless control means comprising a plurality of master units configured to receive alerts from any of said alert detectors within a wireless reception range, whereby each of said master units receives wireless control signals and said wireless alert signals from any of said alert detectors that are within said wireless reception range, wherein each of said master units communicates wireless control signals for reception by other master units within said wireless reception range; and at least one alarm generator coupled to said wireless control means for generating an alarm in response to said wireless control means receiving an alert from at least one of said plurality of alert detectors.

22. The alarm system of claim 21, wherein said wireless control means further comprises at least one local alarm generator.

23. A method for alerting an occupant of emergency conditions within a residence, said method comprising:

detecting an emergency condition at an alert detector;

transmitting a wireless alert signal from said alert detector;

receiving said wireless alert signal at a master control unit;

transmitting an alarm signal from said master control unit to an alarm generator;

second receiving user input of a control command at said master control unit;

responsive to said second receiving, transmitting a wireless control signal from said master control unit;

third receiving said wireless control signal from said master control unit at another master control unit; and responsive to said third receiving, setting a control state of said other master control unit.

24. The method of claim 23, further comprising:

retransmitting said wireless alert signal from said master control unit to a second master control unit; and receiving said wireless alert signal at said second master control unit.

25. The method of claim 23, wherein said alarm generator is a local alarm generator, and wherein said method further comprises:

determining whether or not a predetermined time period commencing with said transmission of said alarm signal has elapsed;

determining whether or not a deactivation has been received at said master control unit; and in response to determining that said predetermined time period has elapsed and a deactivation has not been received, transmitting a second alarm signal to a second master control unit.

* * * * *